United States Patent [19]

Snyder

[11] Patent Number: 4,778,077

[45] Date of Patent: Oct. 18, 1988

[54] LID FOR PORTABLE BINS

[75] Inventor: Andrew W. Snyder, Beatrice, Nebr.

[73] Assignee: Hoover Group, Inc., Roswell, Ga.

[21] Appl. No.: 158,859

[22] Filed: Feb. 22, 1988

[51] Int. Cl.[4] ..... B65D 41/06; B65D 41/36

[52] U.S. Cl. ..... 220/295; 220/293

[58] Field of Search ..... 220/293, 295, 298, 301, 220/302

[56] References Cited

U.S. PATENT DOCUMENTS 3,433,385 3/1969 Metivier ..... 220/293

3,443,718 5/1969 Pst ..... 220/293

*Primary Examiner*—George T. Hall

*Attorney, Agent, or Firm*—Harness, Dickey & Pierce

[57] ABSTRACT

A lid closure assembly for a bin having a top wall and a circular passage through the top wall, the lid assembly comprising a generally circular lid member having a central portion and cylindrical rim portion with an outer diameter less than that of the passage, an outwardly open annular retaining groove in the rim portion having an O-ring seal disposed in the groove, and coacting means on the lid member and on the top wall of the bin for retaining the lid within the passage when the cylindrical rim portion of the lid member extends downwardly into the passage compressing the O-ring to maintain a seal.

8 Claims, 2 Drawing Sheets

FIG. 3
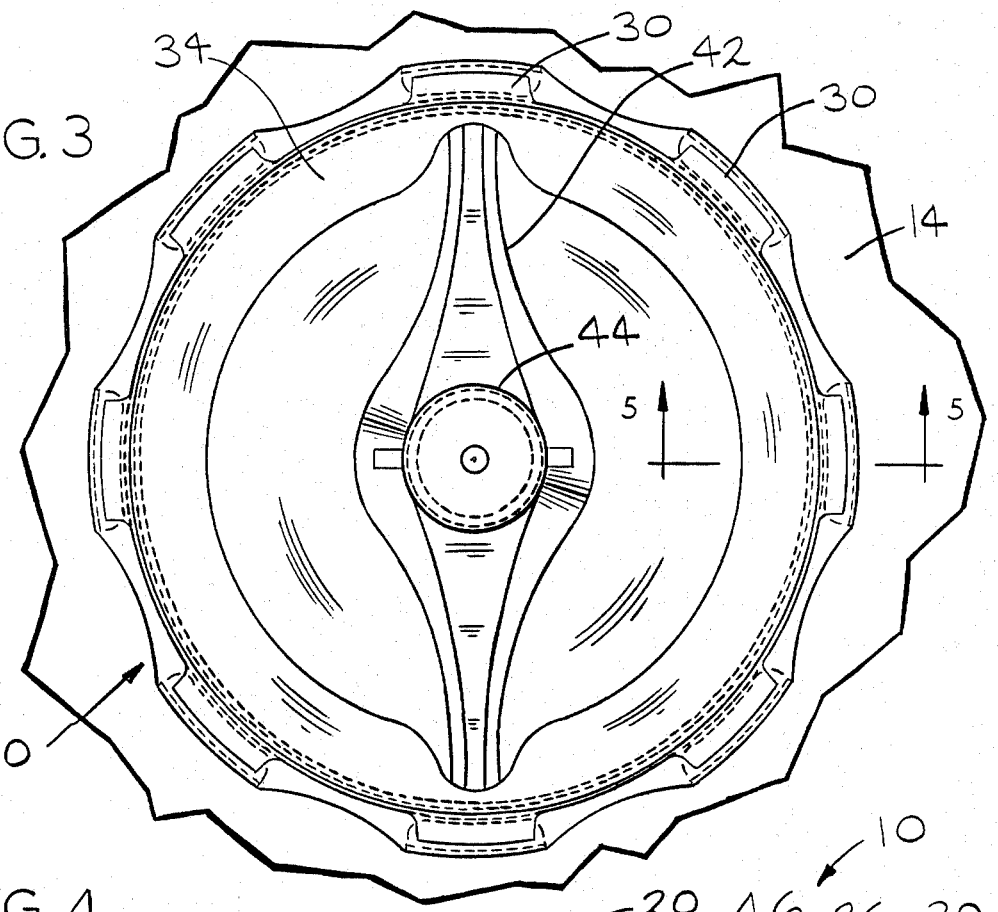
FIG. 4
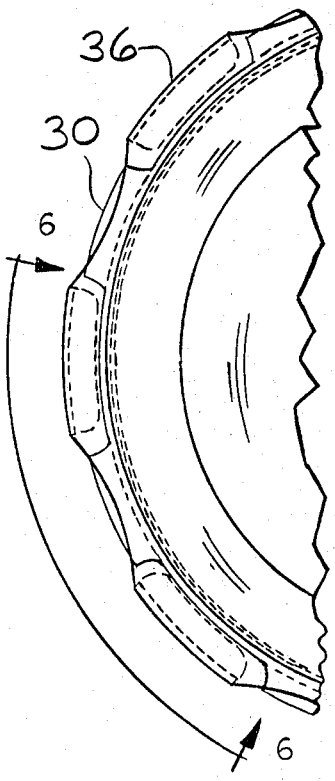
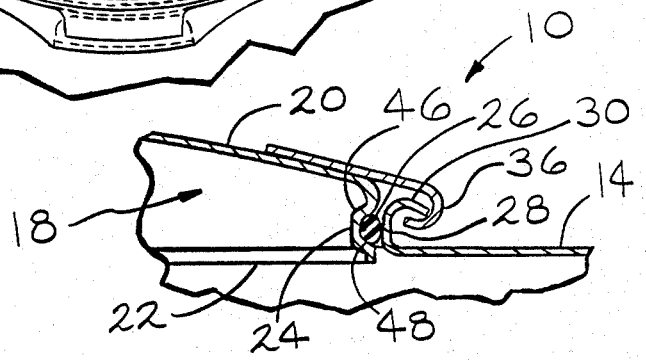
FIG. 5
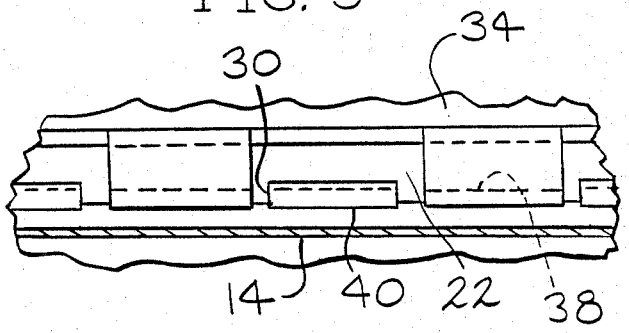
FIG. 6

LID FOR PORTABLE BINS

BACKGROUND AND SUMMARY OF THE INVENTION

This invention relates generally to bins and other bulk material containers and more particularly to a closure assembly for a top opening in a bin having improved seal and lid retaining features.

Closure assemblies, particularly various configurations of lids, are in common use with many tyes of containers and are an essential component in many sealed containers. The object of this invention is to provide an improved closure assembly for a portable bulk material handling bin that provides a positive seal and positive retainers to maintain the lid in a sealed configuration in the opening of the bin.

The closure assembly according to the present invention is designed for application in a bin having a top wall which has a tubular wall portion forming a generally circular passage through the top wall. The closure assembly comprises a generally circular lid having a cylindrical rim portion which fits within the passage.

The rim portion has an outwardly open retaining groove extending circumferentially around the rim portion. Disposed in this groove is an O-ring seal which has a cross-sectional diameter greater than the depth of the groove so that a portion of the O-ring seal projects beyond the edge of the rim. When the lid is positioned within the circular passage in the top wall of the bin this O-ring seal is compressed elastically to provide a positive seal between the lid and the passage walls. In addition, there are coacting means on the lid member and on the top wall for retaining the lid in position enclosing the passage with the cylindrical rim portion extending downwardly into the passage, the O-ring seal being compressed between the rim portion and the tubular wall portion of the top wall.

The coacting means on the lid and the top wall comprises a lid cowling having a ring shaped base portion fixed symmetrically to the lid and having equally spaced hook shaped retainers projecting outwardly from the base portion and beyond the rim portion of the lid. The tubular wall portion of the top wall forming the passage has a like number of outwardly directed tabs which project away from the passage. The retainers engage the outwardly directed tabs when the lid is positioned with the rim portion extending downwardly into the passage to close off the passage and the lid is rotated. Rotating the lid engages the retainers with the tabs thereby securing the lid to the bin.

The closure assembly of the present invention including the O-ring seal disposed groove in the cylindrical portion of the lid has several advantages. First, in a large bin, having the seal member on the lid allows simplified maintenance of the seal. The seal can be conveniently removed, replaced, or cleaned without having to disturb the bin itself. Second, having the seal on the lid allows the tubular passage in the top portion of the bin to be smooth thus preventing accumulation of bulk material on the wall of the passage during filling of the bin. Third, the interlocking tabs and retainers are simply formed from sheet metal thus simplifying the construction of the closure assembly thereby minimizing cost.

Further objects, features, and advantages of this invention will become apparent from a consideration of the following description and the independent claims in connection with the accompanying drawing.

BRIEF DESCRIPTION OF THE DRAWING

FIG. 3 is a partial top view of the bin shown in FIG. 2 showing the detail of the closure assembly according to the present invention;

FIG. 4 is a partial top view of the closure assembly according to the present invention with the retainers and tabs disengaged;

FIG. 5 is a partial sectional view along the line 5—5 in FIG. 3; and

FIG. 6 is a sectional view along the line 6—6 shown in FIG. 4.

DETAILED DESCRIPTION OF THE INVENTION

Figure 1:
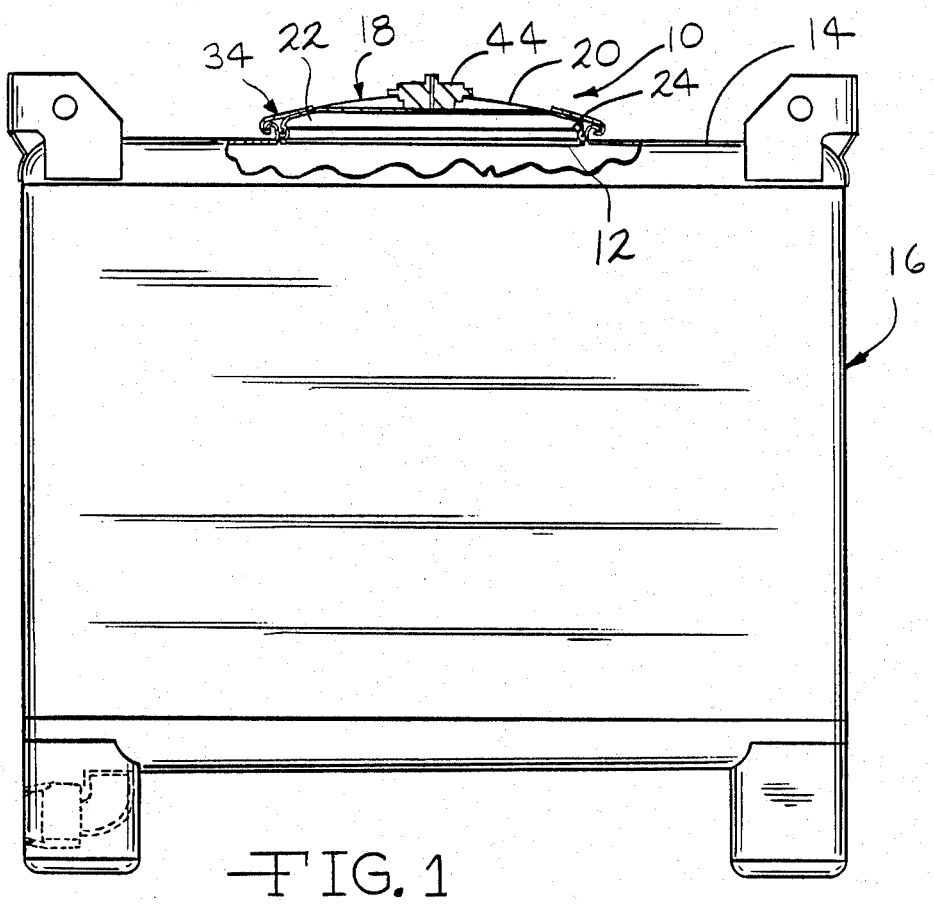
FIG. 1 is a side view of a portable bin including the closure assembly according to the present invention shown in a partial cut away view.

Referring now to the drawing, the closure assembly 10 according to the present invention is shown in FIG. 1 positioned in passage 12 through top wall 14 of bin 16. Closure assembly 10 includes lid member 18 which has a generally circular portion 20 and a cylindrical rim portion 22 which has an outwardly open retaining groove 24 extending circumferentially around rim portion 22. Disposed in groove 24 is O-ring seal 26, is a ring shaped flexible band having a circular cross-section as shown in FIG. 5. O-ring seal 26 is sized so as to have a portion projecting outwardly from and beyond cylindrical rim 22. Lid member 18 is sized so that the cylindrical end portion 22 has a diameter slightly less than that of passage 12 formed in top wall 14. When O-ring seal 26 is disposed in retaining groove 24, the outer diameter of the lid member including the O-ring seal is slightly greater than the diameter of passage 12.

Passage 12 through top wall 14 is formed by tubular wall portion 28 best shown in the cross-sectional view in the FIG. 5. Tubular wall portion 28 is formed in top wall 12 and includes outwardly projecting tabs 30. In the embodiment shown, there are eight equally space tabs 30 around the perimeter of passage 12.

Symmetrically attached to central portion 20 of lid member 18 is a lid cowling 32 having a base portion 34 and having a plurality of hook shaped retainers 36 spaced symmetrically around the outer perimeter of the base portion 34 of lid cowling 32 and projecting outwardly beyond rim portion 22 of lid member 18. In the embodiment shown in FIGS. 1 through 6, lid cowling 32 has eight hook shaped retainers 36 symmetrically spaced around base section 34 for engagement with the eight tabs 30 as shown in FIGS. 3 and 5.

The lid cowling 32 is formed from a flat sheet of metal or other generally rigid material. Hook shaped retainers 36 are bent from the sheet to form retainers having a J-shaped cross-section and having ends 38 as shown in FIG. 6. Similarly, tabs 30 on tubular wall portion 28 have corresponding ends 40. When lid member 18 is inserted within passage 12 compressing seal 26 to provide a positive seal between cylindrical rim portion 22 of lid member 18 and tubular wall portion 28, lid member 18 may be rotated so as to engage tabs 30 with retainers 36 thereby retaining lid member 18 in place. If needed, holes may be drilled in a tab and opposite retainer for receiving a lock pin or lock wire to prevent inadvertant rotation of the lid member 18 out of engagement between tabs 30 and retainers 36.

Figure 2:
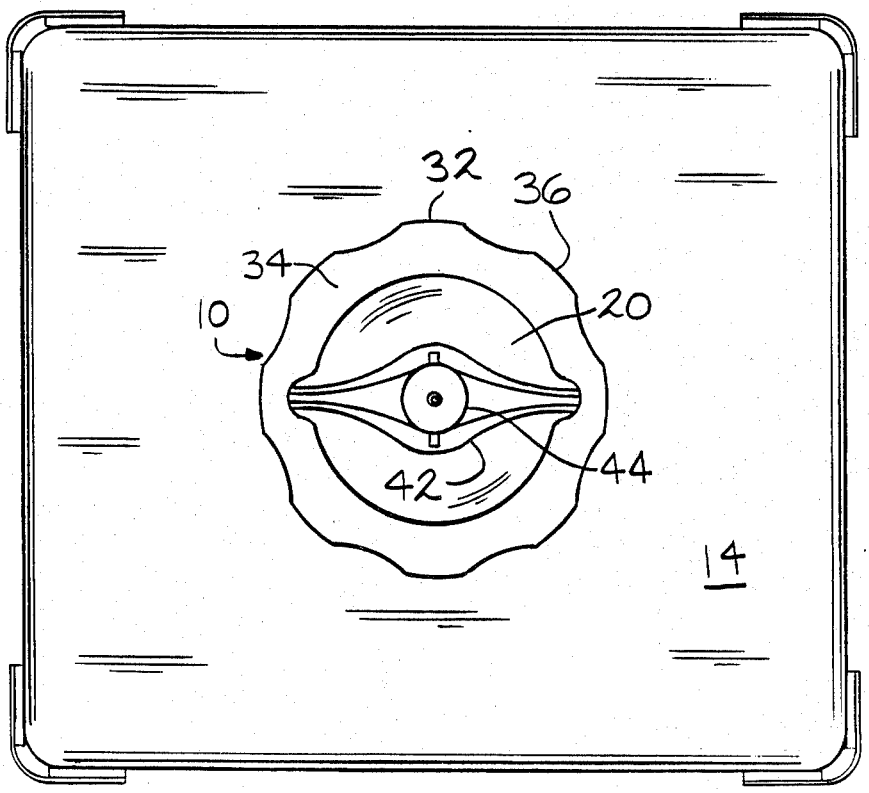
FIG. 2 is a top view of the bin having the closure assembly according to the present invention shown in FIG. 1.

Lid member 18 may have central portion 20 shaped in several configurations. Central portion 20 may be flat or bowed as shown in the embodiment illustrated in FIGS. 1 through 6 and may have a central valley 42 along with a centrally disposed vent cap 44 as shown in FIGS. 1, 2 and 3. Vent cap 44 equalizes the pressure between external atmosphere and the internals of bin 16. Central valley 42 provides a drainage path for moisture that may collect around the base of vent 44.

As shown in FIG. 5, O-ring seal 26 is retained within groove 24 by the coaction of opposing shoulders 46 and 48 on cylindrical rim portion 22. Shoulders 46 and 48 prevent displacement of O-ring seal 26 from cylindrical rim portion 22 as lid member 18 is inserted in or withdrawn from passage 12. In addition, O-ring 26, being flexible, is elastically deformed and uniformly compressed between rim portion 22 and tubular wall portion 28 when the lid member 18 is positioned within passage 12. This provides a positive seal to close passage 12. The coaction of ends 38 and 40 on retainers 36 and tabs 30 respectively secures cylindrical rim portion 22 within passage 12 when lid member 18 is rotated to engage the tabs 30 with retainers 36.

From the above description it is seen that this invention provides and improved closure device for a portable bin utilizing an O-ring seal on the lid member rather than on the top wall thereby simplifying maintenance, and replacement as well as providing a positive seal of the passage in the top bin. The present invention has been described in an illustrative manner and it is to be understood that the terminology which has been used is intended to be in the nature of words of description rather than of limitation. Obviously many modifications and variations of the present invention are possible in light of the above teachings. It is therefore to be understood that within the scope of the appended claims the invention may be practiced otherwise than as specifically described.

What is claimed is:

1. In a bin for storing and transporting bulk material having a top wall with a tubular wall portion forming a generally circular passage through said top wall, a closure assembly for said passage comprising:

a generally circular lid member having a central portion and a cylindrical rim portion with an outer diameter less than that of said passage, said rim portion having an outwardly open retaining groove therein extending circumferentially around said rim portion;

seal means disposed in said groove, and projecting outwardly therefrom; and coacting means on said lid member and said top wall for retaining said lid member in a position closing said passage with said cylindrical rim portion of said lid member extending downwardly into said passage, said seal means being compressed between said cylindrical rim portion and said tubular wall portion of said top wall to seal said passage.

2. The closure assembly according to claim 1 wherein said coacting means comprises:

a lid cowling having a ring shaped base portion fixed symmetrically to said lid member, said cowling having a plurality of hook shaped retainers spaced apart and projecting outwardly from said base portion beyond said rim portion of said lid member; and said tubular wall portion of said top wall having a plurality of outwardly directed tabs projecting away from said tubular wall and said passage for engagement with said retainers on said cowling when said lid is positioned with said rim portion extending downwardly into said passage to close off said passage whereby said lid is secured to said tubular wall portion by said tabs engaging said retainers.

3. The closure assembly according to claim 1 wherein said lid member further includes a centrally disposed cap having a vent hole therein for pressure equalization between said bin and atmosphere.

4. The closure assembly according to claim 3 wherein said central portion of said lid member has a generally outwardly bowed cross section.

5. The closure assembly according to claim 4 wherein said central portion of said lid member further includes a transverse central valley for drainage of moisture accumulation from said cap.

6. The closure assembly according to claim 1 wherein said seal means is a circular O-ring disposed in said retaining groove, said O-ring having an outer diameter greater than that of said passage and an inner diameter less than that of said rim portion whereby said O-ring is retained in said groove, said O-ring being compressed and elastically deformed when said lid member is positioned within said passage to close said passage.

7. In a bin having a top wall with a tubular wall portion forming a generally circular passage through said top wall, a closure assembly for said passage comprising:

a generally circular lid member having a central portion and a cylindrical rim portion with an outer diameter less than that of said passage;

an outwardly open annular retaining groove extending circumferentially around said rim portion, said groove having first and second opposing shoulders extending circumferentially around said cylindrical rim portion;

an O-ring seal, said seal being disposed in said groove and having a portion projecting outwardly therefrom, said shoulders cooperating to retain said O-ring in said groove with said O-ring seal compressed between said cylindrical rim and said tubular wall portion of said top wall to seal said passage; and coacting means on said lid member and said top wall retaining said lid member within said passage with said cylindrical rim portion of said lid member extending downwardly into said passage.

8. The closure assembly according to claim 7 wherein said coacting means comprises:

a lid cowling having a ring shaped base portion fixed symmetrically to said central portion of said lid member, said cowling having a plurality of hook shaped spaced apart retainers projecting outward from said base portion and beyond said rim portion of said lid member; and said tubular wall portion of said top wall having a plurality of outwardly directed tabs projecting away from said tubular wall and said passage for engagement with said retainers on said cowling when said lid is positioned to close off said passage whereby said lid is secured within said passage by coaction between said engaged tabs and retainers.

* * * * *